US010001037B2

(12) United States Patent
Nishimura et al.

(10) Patent No.: US 10,001,037 B2
(45) Date of Patent: Jun. 19, 2018

(54) VARIABLE VALVE MECHANISM

(71) Applicant: TOYOTA JIDOSHA KABUSHIKI KAISHA, Toyota-shi (JP)

(72) Inventors: Yuta Nishimura, Toyota (JP); Atsuhisa Tamano, Anjo (JP); Yu Yokoyama, Okazaki (JP); Toshiyuki Yano, Nagakute (JP); Toru Sakuma, Nisshin (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 98 days.

(21) Appl. No.: 15/297,351

(22) Filed: Oct. 19, 2016

(65) Prior Publication Data

US 2017/0122141 A1 May 4, 2017

(30) Foreign Application Priority Data

Oct. 29, 2015 (JP) ..... 2015-213009

(51) Int. Cl.
*F01L 1/46* (2006.01)
*F01L 1/344* (2006.01)
(Continued)

(52) U.S. Cl.
CPC ..... *F01L 1/344* (2013.01); *F01L 1/185* (2013.01); *F01L 1/267* (2013.01); *F01L 1/46* (2013.01); *F01L 2001/0473* (2013.01); *F01L 2001/0537* (2013.01); *F01L 2001/34496* (2013.01); *F01L 2013/0052* (2013.01); *F01L 2013/101* (2013.01); *F01L 2105/00* (2013.01)

(58) Field of Classification Search
CPC ..... F01L 2001/0473; F01L 1/267; F01L 1/34413; F01L 1/46; F01L 13/0042; F01L 2013/0052
USPC ..... 123/90.16, 90.18
See application file for complete search history.

(56) References Cited

U.S. PATENT DOCUMENTS

2010/0269769 A1 10/2010 Schoeneberg et al.
2012/0024245 A1* 2/2012 Nendel ..... F01L 13/0036 123/90.6

(Continued)

FOREIGN PATENT DOCUMENTS

JP 2010-520395 6/2010
JP 2014-152654 A 8/2014

(Continued)

*Primary Examiner* — Jorge Leon, Jr.
(74) *Attorney, Agent, or Firm* — Oblon, McClelland, Maier & Neustadt, L.L.P.

(57) ABSTRACT

In a variable valve mechanism, a guide groove includes guide portions provided on respective side surfaces of the guide groove in a width direction, the guide portions projecting so as to face each other; a cam unit is slid toward a first side by relatively moving a shift pin toward a second side with use of the guide portion on the first side, and the cam unit is slid toward the second side by relatively moving the shift pin toward the first side with use of the guide portion on the second side; the guide portion on the first side is provided in an immovable piece, and the guide portion on the second side is provided in a movable piece; the movable piece is displaceable between a first position and a second position: and a first urging member configured to urge the movable piece toward the first position is provided.

5 Claims, 9 Drawing Sheets

(51) Int. Cl.

| | |
|---|---|
| *F01L 1/26* | (2006.01) |
| *F01L 1/047* | (2006.01) |
| *F01L 1/18* | (2006.01) |
| *F01L 1/053* | (2006.01) |
| *F01L 13/00* | (2006.01) |

(56) References Cited

U.S. PATENT DOCUMENTS

| | | | | |
|---|---|---|---|---|
| 2012/0222635 | A1 | 9/2012 | Sunada et al. | |
| 2015/0184554 | A1* | 7/2015 | Nendel | F01L 13/0036 123/90.17 |
| 2016/0237863 | A1* | 8/2016 | Cecur | F01L 13/00 |

FOREIGN PATENT DOCUMENTS

| | | | |
|---|---|---|---|
| JP | 2015-068253 | A | 4/2015 |
| WO | 2011/064852 | A1 | 6/2011 |

* cited by examiner

VARIABLE VALVE MECHANISM

INCORPORATION BY REFERENCE

The disclosure of Japanese Patent Application No. 2015-213009 filed on Oct. 29, 2015 including the specification, drawings and abstract is incorporated herein by reference in its entirety.

BACKGROUND

1. Technical Field

The disclosure relates to a variable valve mechanism used for a valve system or the like of an engine, for example, and particularly, relates to a cam-switching variable valve mechanism in which any one of a plurality of cams is selected by sliding a cam unit in an axial direction (a cam axial direction), the cam unit being provided around a camshaft.

2. Description of Related Art

Conventionally, as a variable valve mechanism that can change a lift characteristic of an intake valve or an exhaust valve of an engine, a Variable Valve Timing (VVT) that can continuously change a valve timing is used widely. Further, as described in Japanese Patent Application Publication No. 2010-520395 (JP 2010-520395 A), for example, there has been publicly known a cam-switching variable valve mechanism in which a cam carrier (a cam unit) provided with a plurality of cams is provided around a camshaft, and any one of the cams is selected by sliding the cam carrier in an axial direction of the camshaft.

In the variable valve mechanism according to the conventional example, a spiral guide groove is provided on an outer periphery of the cam carrier, and an engagement element (hereinafter referred to as a shift pin) of a servo-mechanism is engaged with the guide groove from the outside. In the configuration, when the cam carrier rotates integrally with the camshaft, the shift pin relatively moves along the guide groove. This practically maintains the engagement between the guide groove and the shift pin, and thus, the cam carrier slides in the cam axial direction.

More specifically, as illustrated in FIG. 8, a guide groove G in the conventional example is configured in a Y-shape as a whole such that an S-shaped groove g1 and a reverse S-shaped groove g2 formed on an outer periphery of a cam carrier C so as to extend in a circumferential direction are joined to each other. When the cam carrier C is moved toward a left side in FIG. 8, the shift pin P is inserted into the S-shaped groove g1, and the shift pin P is relatively moved along the groove g1 toward a right side in FIG. 8.

SUMMARY

There is a request for making a valve system of an engine compact (i.e., there is a request for reducing the size of a valve system of an engine). However, in the cam carrier C of the conventional example, a width of the Y-shaped guide groove G tends to be large, which makes it difficult to reduce the size of the valve system. The reason is as follows. That is, as illustrated in a development view of FIG. 9, the Y-shaped guide groove G requires at least a width of 2×S+D, when S indicates a slide amount for switching between cams with the use of the S-shaped groove g1 and the reverse S-shaped groove g2 and D indicates a diameter of the shift pin P.

Further, in the conventional example, in order to move the cam carrier C to the left side, a shift pin P to be engaged with the S-shaped groove g1 is required, and in order to move the cam carrier C to the right side, a shift pin P to be engaged with the reverse S-shaped groove g2 is required. This accordingly requires two servo-mechanisms, or in order to operate two shift pins P by one servo-mechanism, a complicated structure is required. This causes an increase in cost.

The disclosure makes it possible to reduce the size of a cam unit in a variable valve mechanism for an engine or the like while suppressing an increase in cost.

In one aspect of the disclosure, a guide groove is provided in an X-shape in which a pair of guide portions projects from respective side surfaces of the guide groove in a width direction of the guide groove (hereinafter also referred to as a groove-width direction) such that the guide portions face each other. A width of the guide groove is reduced as compared to a Y-shaped guide groove such as the guide groove in the conventional example. Further, the guide groove is divided into two parts in the width direction and the two parts are displaced from each other in a direction in which a camshaft rotates (and a direction opposite to the direction in which the camshaft rotates), thereby allowing a shift pin to pass through between the pair of guide portions.

An aspect of the disclosure relates to a variable valve mechanism including a cam unit having a cylindrical shape and including a plurality of cams, the cam unit being provided around a camshaft; and a shift pin. Any one of the plurality of cams provided in the cam unit is selected by engaging the shift pin, from an outside, with a guide groove provided on an outer periphery of the cam unit so as to slide the cam unit in an axial direction of the camshaft (i.e., a cam axial direction) along with rotation of the camshaft.

The guide groove includes a pair of guide portions provided on respective side surfaces of the guide groove in a width direction of the guide groove, the pair of guide portions projecting so as to face each other. The guide groove is configured such that the cam unit is slid toward a first side by relatively moving the shift pin toward a second side opposite to the first side with use of the guide portion on the first side in the pair of guide portions, and the cam unit is slid toward the second side by relatively moving the shift pin toward the first side with use of the guide portion on the second side in the pair of guide portions.

The cam unit includes an immovable piece provided so as not to pivot relative to the cam unit and a movable piece provided so as to be pivotable relative to the cam unit. The guide groove is divided into two parts in the width direction of the guide groove, the guide portion on the first side is provided in the immovable piece, and the guide portion on the second side is provided in the movable piece. The movable piece is displaceable relative to the immovable piece between a first position and a second position, the first position being a position to which the movable piece pivots in a direction in which the camshaft rotates (i.e., pivots toward a front side in a cam rotation direction), and the second position being a position to which the movable piece pivots in a direction opposite to the direction in which the camshaft rotates (i.e., pivots toward a rear side in the cam rotation direction). A first urging member configured to urge the movable piece toward the first position is provided.

In the variable valve mechanism configured as described above, first, when the movable piece of the cam unit is moved relative to the immovable piece of the cam unit and is placed at the first position to which the movable piece pivots in the direction in which the camshaft rotates, the shift pin is engaged with the side surface of the guide groove on the first side. With this configuration, along with rotation of the camshaft and the cam unit, the shift pin is relatively moved toward the second side by the guide portion on the first side while sliding along the side surface on the first side. This makes it possible to slide the cam unit toward the first side in the cam axial direction (which is the same as the groove-width direction).

At this time, the movable piece is placed at the first position, and the guide portion on the second side, which is provided in the movable piece, is displaced toward the front side in the rotation direction relative to the guide portion on the first side, which is provided in the immovable piece. Accordingly, a distance between the pair of guide portions is increased. Thus, although the width of the guide groove is reduced, the shift pin can pass through between the pair of guide portions such that the shift pin is relatively moved from the first side to the second side in the width direction of the guide groove.

When the shift pin is engaged with the side surface of the guide groove on the second side, the shift pin is relatively moved toward the first side by the guide portion on the second side while sliding along the side surface on the second side, along with the rotation of the camshaft and the cam unit. Thus, the cam unit is slid toward the second side in the cam axial direction. Further, when the shift pin thus presses the guide portion on the second side, the movable piece pivots toward a rear side in the rotation direction so as to be displaced to the second position. Since the guide portion on the second side is displaced toward the rear side in the rotation direction relative to the guide portion on the first side, the distance between the guide portions becomes large. Thus, the shift pin can pass through between the guide portions such that the shift pin is relatively moved from the second side to the first side in the width direction of the guide groove.

That is, when the shift pin is engaged with the side surface of the guide groove having an X-shape on the first side or the second side and the shift pin is relatively moved by the guide portion from the first side to the second side or from the second side to the first side, it is possible to slide the cam unit in the cam axial direction in a reciprocating manner. Accordingly, when a slide amount of the cam unit is indicated by S and a diameter of the shift pin is indicated by D, a width (a length in the cam axial direction) of the guide groove required for relative movement of the shift pin is approximately S+D, and thus, the cam unit has the reduced size, as compared to the conventional example that requires a length of at least 2×S+D.

Further, in order to move the cam unit to the first side, the shift pin is engaged with the side surface of the guide groove on the first side, and in order to move the cam unit to the second side that is opposite to the first side, the shift pin is engaged with the side surface of the guide groove on the second side. That is, when the side, to which the cam unit is moved, is changed, only the side surface of the guide groove, with which the shift pin is engaged, is changed to the side surface on the first side or the side surface on the second side. Thus, only one shift pin is necessary. Accordingly, it is possible to achieve reduction in cost as compared to the conventional example that requires two shift pins. As a result, although the movable piece is provided in the cam unit, an increase in cost can be suppressed.

The first urging member that urges the movable piece toward the front side in the rotation direction relative to the immovable piece may be configured to operate with use of a hydraulic pressure of a lubrication system of an engine, for example. The first urging member may be constituted by a spring member provided between the movable piece and the immovable piece. This simplifies the structure, which is advantageous for suppressing an increase in cost.

Each of the pair of guide portions may include a guide face portion configured such that a projecting amount of the guide face portion gradually decreases from a projecting end of the guide portion toward a front side in the direction in which the camshaft rotates; and a distance between the projecting ends facing each other may be smaller than an outside diameter of the shift pin in the width direction of the guide groove. With this configuration, the shift pin is smoothly guided to the projecting end by the guide surface portion on the side surface of the guide groove on the first side or the second side. Further, at the projecting end, a center of the shift pin is easily moved relatively toward the opposed side surface on the opposite side across a central position of the guide groove in the width direction.

One of the camshaft and the cam unit may be provided with a projection projecting toward the other one of the camshaft and the cam unit; and the other one of the camshaft and the cam unit may be provided with a locking member such that the locking member is pressed by a second urging member toward the projection and the locking member moves across the projection at a central position in a slide of the cam unit. With this configuration, for example, in a case where the cam unit slides from the first side to the second side, the locking member moves across the projection when the cam unit passes the central position, and after that, the cam unit slides toward the second side without returning to the first side.

With the variable valve mechanism according to the above aspect of the disclosure, the cam unit is slid in a reciprocating manner by engaging the shift pin with the side surface of the guide groove on the first side or the second side. Accordingly, the guide groove does not need to have a large width (a large length in the cam axial direction) in contrast to the Y-shaped guide groove in the conventional example. Thus, it is possible to reduce the size of the cam unit (that is, the cam unit has the reduced size). Further, it is possible to slide the cam unit in a reciprocating manner by the one shift pin, thereby making it possible to suppress an increase in cost.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

The following will describe an embodiment in which the disclosure is applied to a valve system of an engine, with reference to the drawings. An engine 1 of the present embodiment is an in-line four-cylinder gasoline engine 1 as an example. As schematically illustrated in FIG. 1, four cylinders, i.e., first to fourth cylinders 3 (#1 to #4) are arranged in a longitudinal direction of a cylinder block (not shown), i.e., in a front-rear direction (a right-left direction indicated by an arrow in FIG. 1) of the engine 1.

Figure 1:
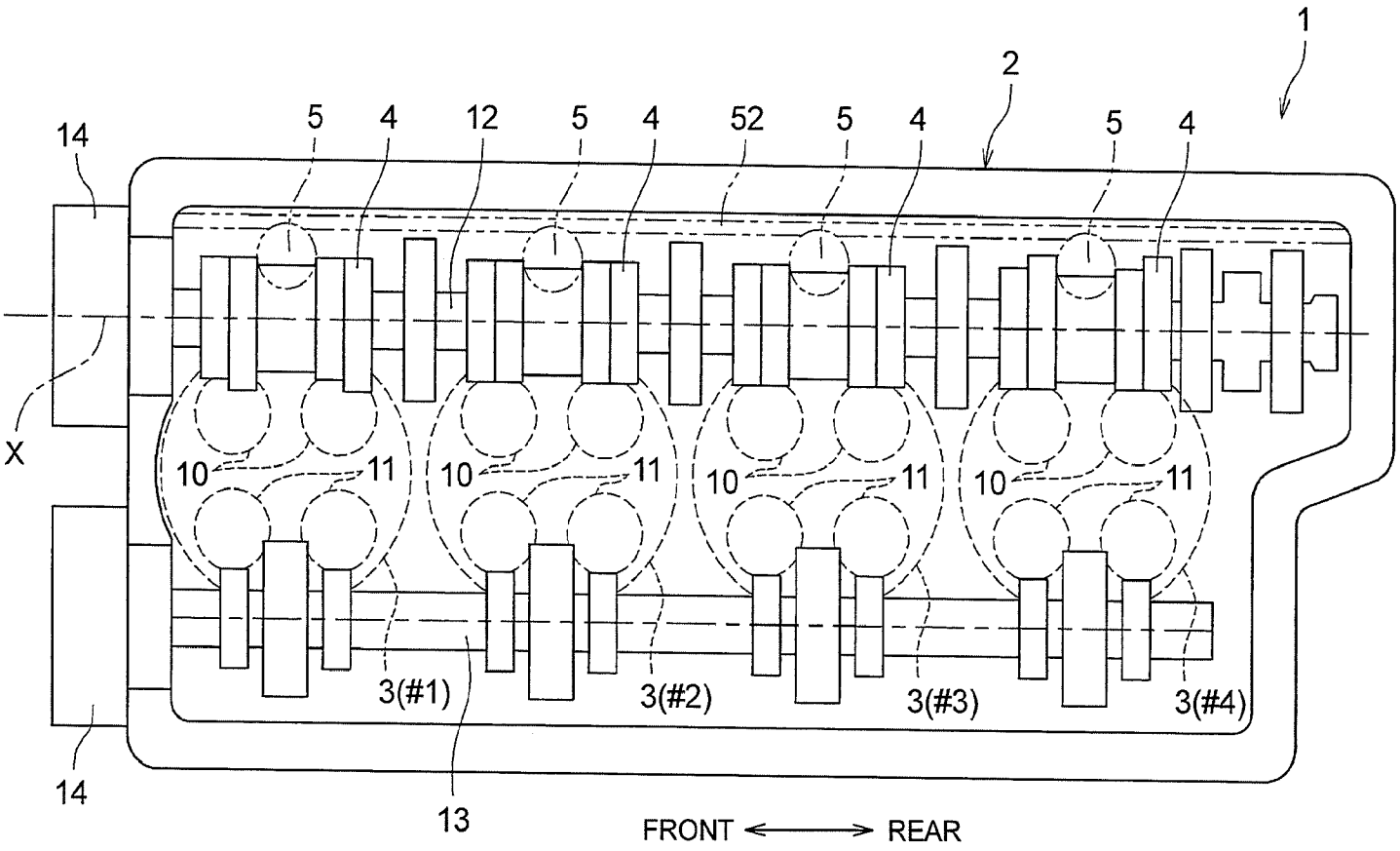
FIG. 1 is a schematic configuration diagram of a valve system of an engine, which is provided with a variable valve mechanism according to an embodiment.

When viewed from above in FIG. 1, a cam housing 2 is disposed in an upper part (a cylinder head) of the engine 1, so as to accommodate valve systems for intake valves 10 and exhaust valves 11. That is, as indicated by a broken line in FIG. 1, the four cylinders 3 arranged in line in the front-rear direction of the engine 1 are each provided with two intake valves 10 and two exhaust valves 11, which are driven by an intake camshaft 12 and an exhaust camshaft 13, respectively.

A front end (left end in FIG. 1) of each of the intake camshaft 12 and the exhaust camshaft 13 is provided with a Variable Valve Timing (VVT) 14 that can continuously change valve timing. Further, the intake camshaft 12 is provided with a cam switch mechanism (an example of a variable valve mechanism of the disclosure) that changes a lift characteristic of the intake valve 10 by switching between cams 41, 42 that drive the intake valve 10 (see FIG. 2). The cam switch mechanism is provided for each cylinder 3.

Figure 2:
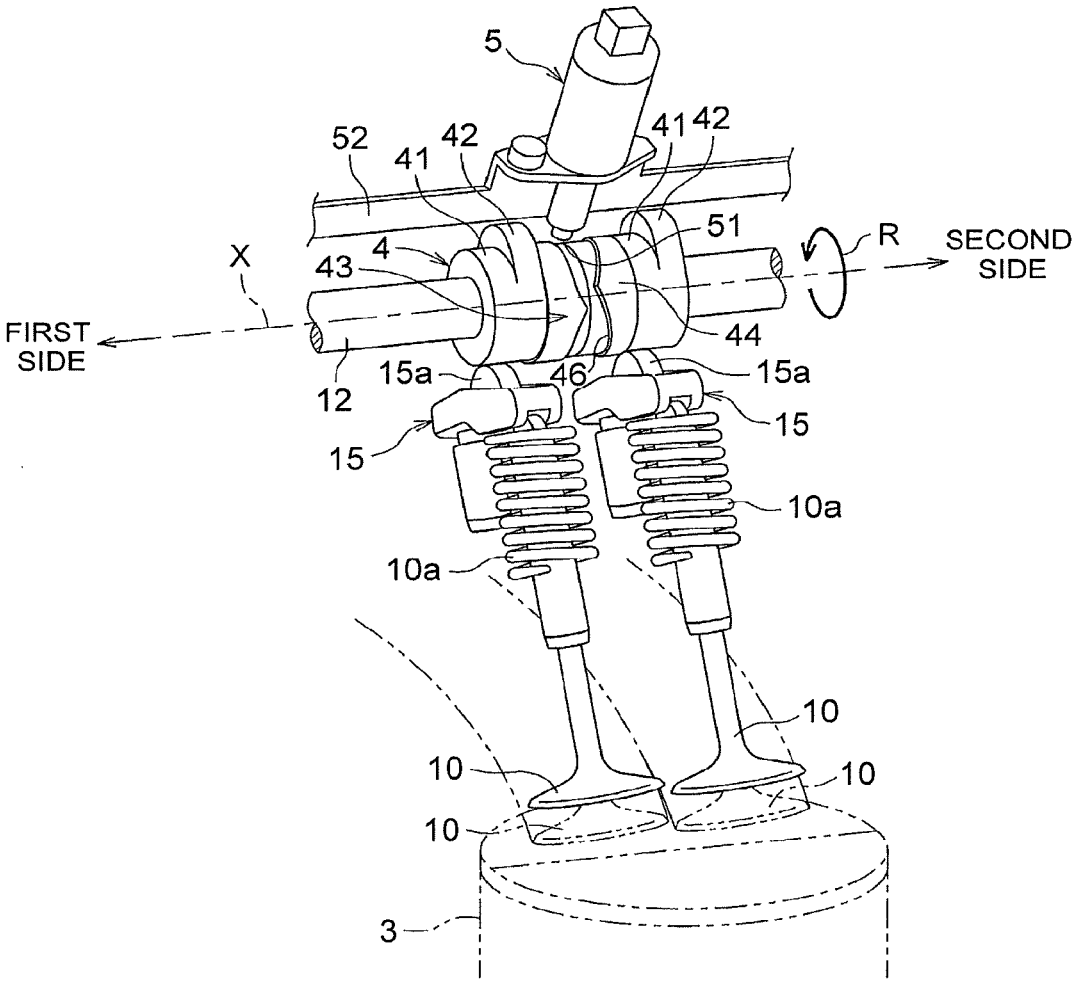
FIG. 2 is a perspective view illustrating a portion of an intake-side valve system in an enlarged manner, the portion relating to a given cylinder.

FIG. 2 illustrates the second cylinder 3 (#2), as an example, in an enlarged manner. As illustrated in FIG. 2, the two cams 41, 42 having different profiles are provided for each of two intake valves 10 in each cylinder 3 such that any one of the two cams 41, 42 drives the corresponding intake valve 10 via a rocker arm 15. The two cams 41, 42 are provided adjacent to each other in a direction of an axis X of the intake camshaft 12 (a cam axial direction). In FIG. 2, the cam 41 on the left side (first side) is a low lift cam 41 having a relatively small cam lobe, and the cam 42 on the right side (second side) is a high lift cam 42 having a relatively large cam lobe.

Base circles of the low lift cam 41 and the high lift cam 42 have the same diameter, and are formed as arc surfaces continuous with each other. FIG. 2 illustrates a state where the low lift cam 41 is selected, and a roller 15*a* of the rocker arm 15 contacts a base circle zone of the low lift cam 41, and the roller 15*a* is pressed against the low lift cam 41 by a reaction force of a valve spring 10*a* of the intake valve 10. In a state where the roller 15*a* of the rocker arm 15 thus contacts the base circle zone, the intake valve 10 does not lift.

When the intake camshaft 12 rotates in a direction indicated by an arrow R, the cam lobe of the low lift cam 41 presses the roller 15*a* so as to push down the rocker arm 15, although not illustrated herein. This causes the rocker arm 15 to drive the intake valve 10 in accordance with the profile of the cam lobe, and thus, the intake valve 10 lifts, as indicated by a virtual line in FIG. 2, against the reaction force of the valve spring 10*a*.

Figure 3:
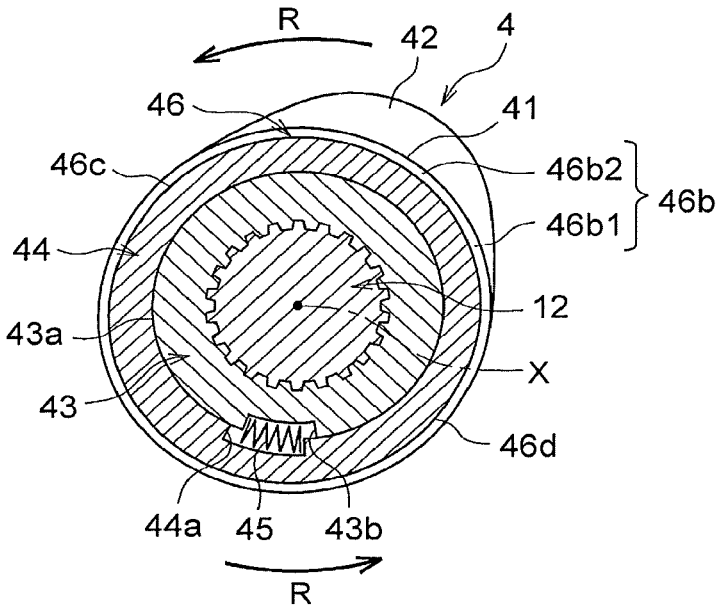
FIG. 3 is a cross-sectional view of a cam unit provided around an intake camshaft.
Figure 4:
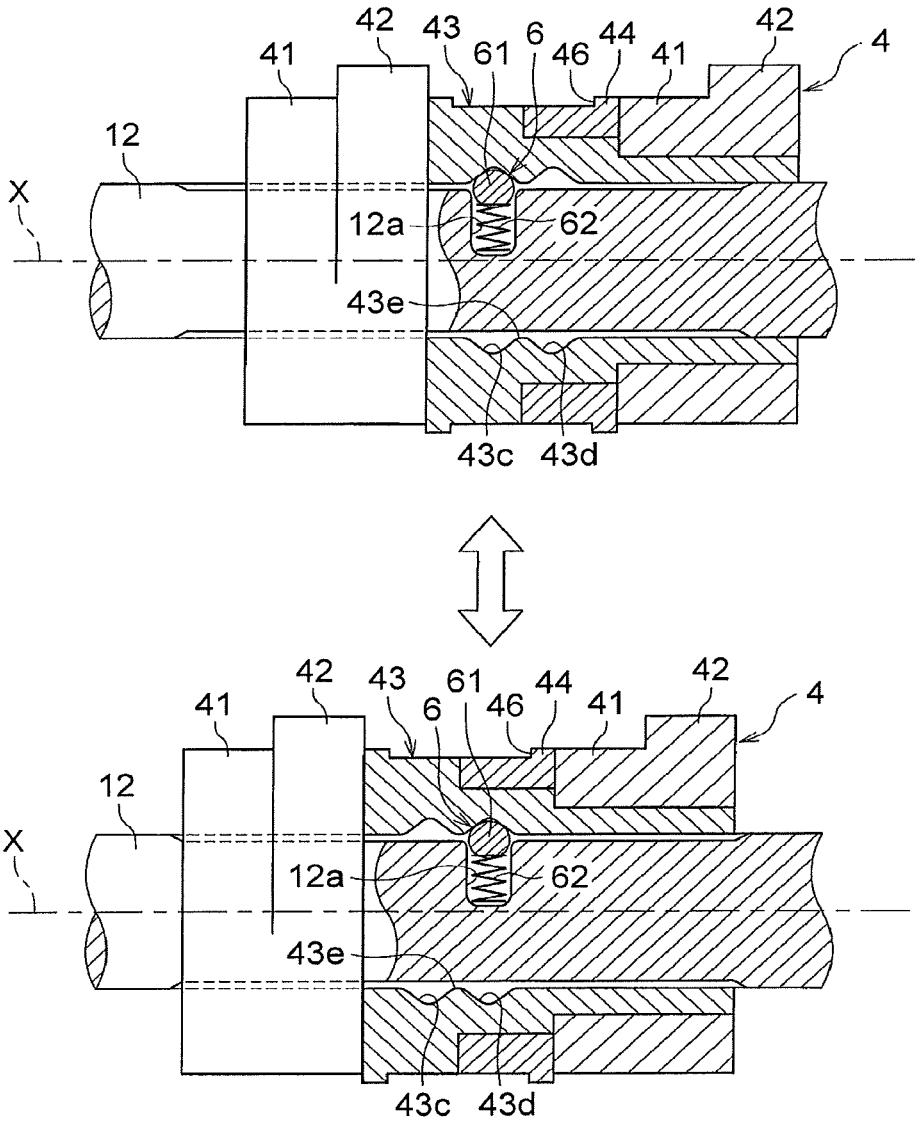
FIG. 4 is a drawing of a longitudinal section of the cam unit.

In the present embodiment, a cam that lifts the intake valve 10 via the rocker arm 15 is switched between the low lift cam 41 and the high lift cam 42, as described above. That is, as illustrated in FIGS. 3 and 4, in addition to FIG. 2, the two cams 41, 42 are formed integrally in a ring shape and fitted to an end portion of a cylindrical sleeve 43 in its X-axis direction, thereby constituting a cam unit 4. The cam unit 4 (the sleeve 43) is slidably provided around the intake camshaft 12.

As illustrated in a cross section perpendicular to the axis X in FIG. 3, internal teeth of a spline is formed on an inner periphery of the sleeve 43 of the cam unit 4 and mesh with external teeth of a spline formed on an outer periphery of the intake camshaft 12. That is, the cam unit 4 (the sleeve 43) is spline-connected to the intake camshaft 12. The cam unit 4 rotates integrally with the intake camshaft 12, and slides thereon in the X-axis direction such that the cam unit 4 is switched to a low lift position or a high lift position.

Further, as illustrated in FIG. 3 and FIG. 4, a reduced diameter part 43*a* is formed in the second side (the right side in FIG. 4) of the sleeve 43 in the X-axis direction, and a ring-shaped movable piece 44 is provided around the reduced diameter part 43*a*. That is, the sleeve 43 is an immovable piece that cannot pivot relative to the cam unit 4 (i.e., an immovable piece that is provided so as not to pivot relative to the cam unit 4), and the movable piece 44 is fitted to the sleeve 43 such that the movable piece 44 can pivot relative to the cam unit 4 (i.e., the movable piece 44 is provided so as to be pivotable relative to the cam unit 4). As illustrated in FIG. 3, a coil spring 45 is disposed between the sleeve 43 and the movable piece 44, and urges the movable piece 44 by its spring force such that the movable piece 44 pivots, relative to the sleeve 43, toward a front side in a direction (hereinafter also referred to as a cam rotation direction) in which the intake camshaft 12 rotates.

More specifically, a groove 43*b* extending in a circumferential direction is formed on an outer periphery of the reduced diameter part 43*a* of the sleeve 43, a groove 44*a* is formed on an inner periphery of the movable piece 44 so as to face the groove 43*b*, and an accommodation chamber for the coil spring 45 is formed. One end (a front end in the cam rotation direction) of the coil spring 45 contacts one end of the groove 44*a* on the movable piece 44, and the other end (a rear end in the cam rotation direction) of the coil spring 45 contacts the other end of the groove 43*b* on the sleeve 43 such that the movable piece 44 is urged toward the front side in the cam rotation direction by a spring force of the coil spring 45.

Figure 5:
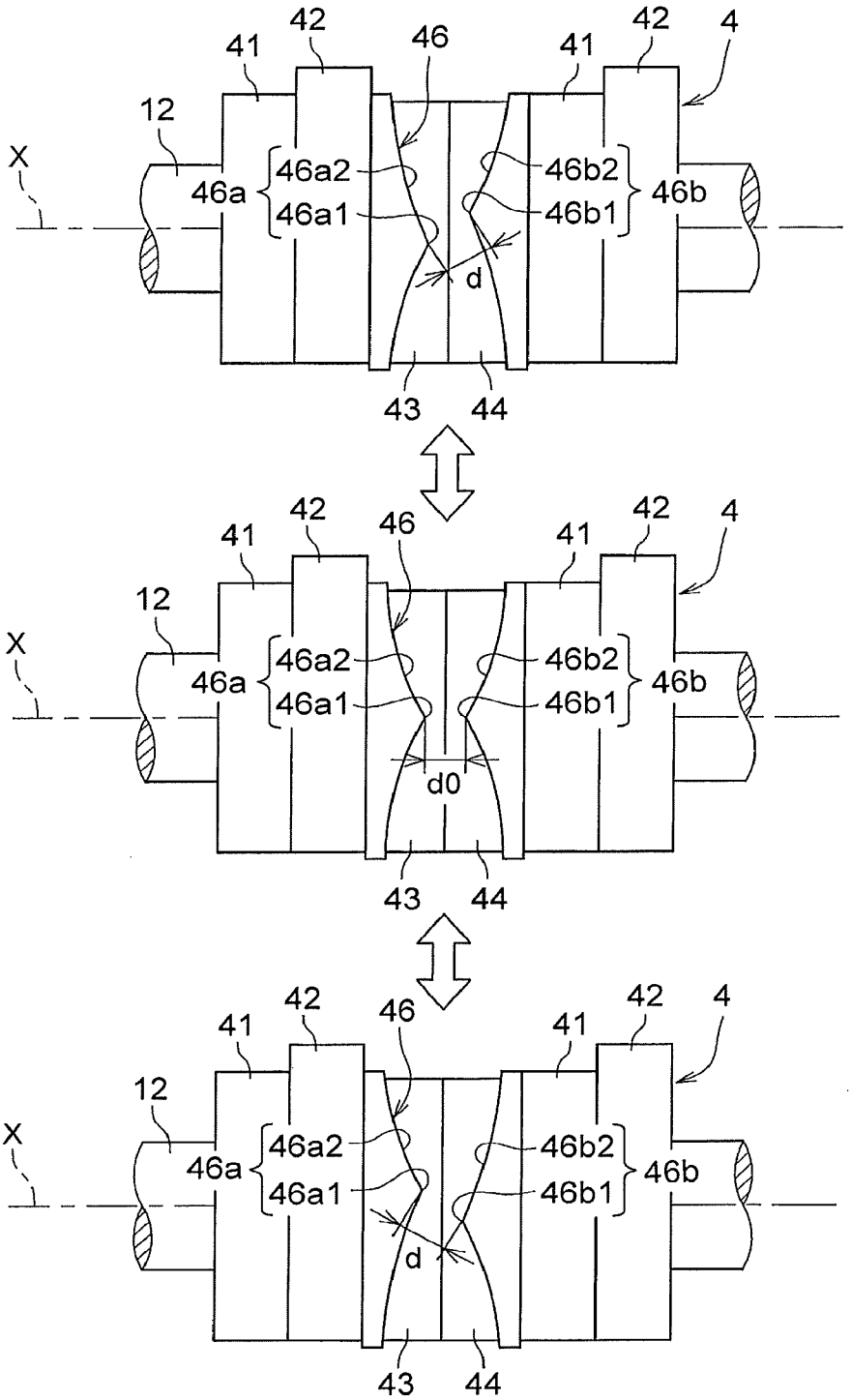
FIG. 5 is a view illustrating a change of a guide groove due to pivoting of a movable piece of the cam unit.

In order to slide the cam unit 4 thus configured in the X-axis direction along the intake camshaft 12, a guide groove 46 to be engaged with the shift pin 51 is provided on an outer periphery of the cam unit 4, as described below. As illustrated in FIG. 5 as well as FIGS. 2 to 4, the guide groove 46 is provided so as to extend in the circumferential direction over a whole outer periphery of the cam unit 4, and a pair of guide portions 46*a*, 46*b* projects so as to face each other. The guide portions 46*a*, 46*b* are provided on respective side surfaces of the guide groove 46 in a width direction of the guide groove 46 (which is the same as the X-axis direction, and hereinafter also referred to as a groove-width direction). The guide portions 46*a*, 46*b* are provided in a substantially X-shape.

That is, as illustrated in FIG. 2, an actuator 5 is provided for each cylinder 3 so as to be disposed above the intake camshaft 12. The actuator 5 is configured to drive the shift pin 51 such that the shift pin 51 reciprocates (i.e., the shift pin 51 advances and moves back). The actuator 5 is supported by the cam housing 2 via a stay 52 extending in the X-axis direction, for example. The actuator 5 drives the shift pin 51 by an electromagnetic solenoid. When the actuator 5 is in an ON state, the shift pin 51 moves toward the guide groove 46 (i.e., the shift pin 51 advances) so as to be engaged with the guide groove 46.

When the shift pin 51 advances so as to be engaged with a side surface of the guide groove 46 on the first side or the second side in the width direction, the shift pin 51 relatively moves on the outer periphery of the cam unit 4 in the circumferential direction and also moves in a width direction of the guide groove 46, namely, in a diagonal manner along with rotation of the intake camshaft 12, which will be described later with reference to FIG. 6. At this time, the cam unit 4 practically slides relative to the shift pin 51 in the X-axis direction while rotating relative to the shift pin 51.

For example, in a case where the cam unit 4 is placed at the low lift position as illustrated in FIG. 2, when the actuator 5 is turned on, the shift pin 51 advances and is engaged with the side surface of the guide groove 46 on the first side (on the left side in FIG. 2) in the X-axis direction. Along with rotation of the intake camshaft 12 as indicated by an arrow R, the shift pin 51 relatively moves along the side surface of the guide groove 46 on the first side, and thus, the shift pin 51 practically presses the cam unit 4 toward the left side in the figure such that the cam unit 4 slides.

Further, in the present embodiment, the guide groove 46 is provided on the sleeve 43 and the movable piece 44 of the cam unit 4. In other words, the guide groove 46 is divided in two parts on the sleeve 43-side (the left side) and the movable piece 44-side (the right side) at a center in the groove-width direction, as illustrated in FIG. 5. As described above with reference to FIG. 3 and so on, when the movable piece 44 pivots relative to the sleeve 43, a positional relationship between both side surfaces of the guide groove 46 changes.

Hereinafter, in a case where the description is made with reference to FIGS. 5, 6, the first side in the width direction (the X-axis direction) of the guide groove 46 is referred to as the left side and the second side is referred to as the right side, for convenience. First, as illustrated in a center of FIG. 5, guide portions 46*a*, 46*b* on the left and right side surfaces of the guide groove 46 include guide face portions 46*a*2, 46*b*2 configured such that projecting amounts of the guide face portions 46*a*2, 46*b*2 gradually decrease from respective projecting ends 46*a*1, 46*b*1 toward the front side (an upper side in the figure) in the cam rotation direction. Further, a distance d0, in the groove-width direction, between the projecting ends 46*a*1, 46*b*1 facing each other is smaller than an outside diameter D of the shift pin 51 (see a lower side in FIG. 6).

Note that, as described above with reference to FIG. 3, the movable piece 44 is pivotable relative to the sleeve 43 of the cam unit 4, and the movable piece 44 pivots between a first position and a second position. The first position is a position to which the movable piece 44 pivots forward in the cam rotation direction relative to the sleeve 43 as illustrated on an upper side in FIG. 5. The second position is a position to which the movable piece 44 pivots rearward in the cam rotation direction relative to the sleeve 43 as illustrated on a lower side in FIG. 5. Further, the movable piece 44 is urged by the coil spring 45 toward the front side in the cam rotation direction, that is, toward the first position.

On this account, as illustrated on the upper side in FIG. 5, the projecting end 46*b*1 of the guide portion 46*b* on the right side surface of the guide groove 46 is placed on the front side in the cam rotation direction relative to the projecting end 46*a*1 of the guide portion 46*a* on the left side surface. Since the projecting ends 46*a*1, 46*b*1 are thus displaced from each other in the front-rear direction along the cam rotation direction, a distance d between the projecting ends 46*a*1, 46*b*1 facing each other is larger than a distance d0 in the groove-width direction, more specifically, larger than the outside diameter D of the shift pin 51.

Thus, in the present embodiment, as will be described below with reference to FIG. 6, when the shift pin 51 is engaged with the right or left side surface of the guide groove 46 so as to slide the cam unit 4, the shift pin 51 passes through between the pair of guide portions 46*a*, 46*b* (i.e., between the projecting ends 46*a*1, 46*b*1). That is, for example, when the shift pin 51 is engaged with the left side surface of the guide groove 46 as illustrated on an upper side in FIG. 6, the shift pin 51 slides along the left guide face portion 46*a*2 along with the rotation of the intake camshaft 12 and the cam unit 4, and reaches the projecting end 46*a*1 as illustrated in a center in FIG. 6.

Figure 6:
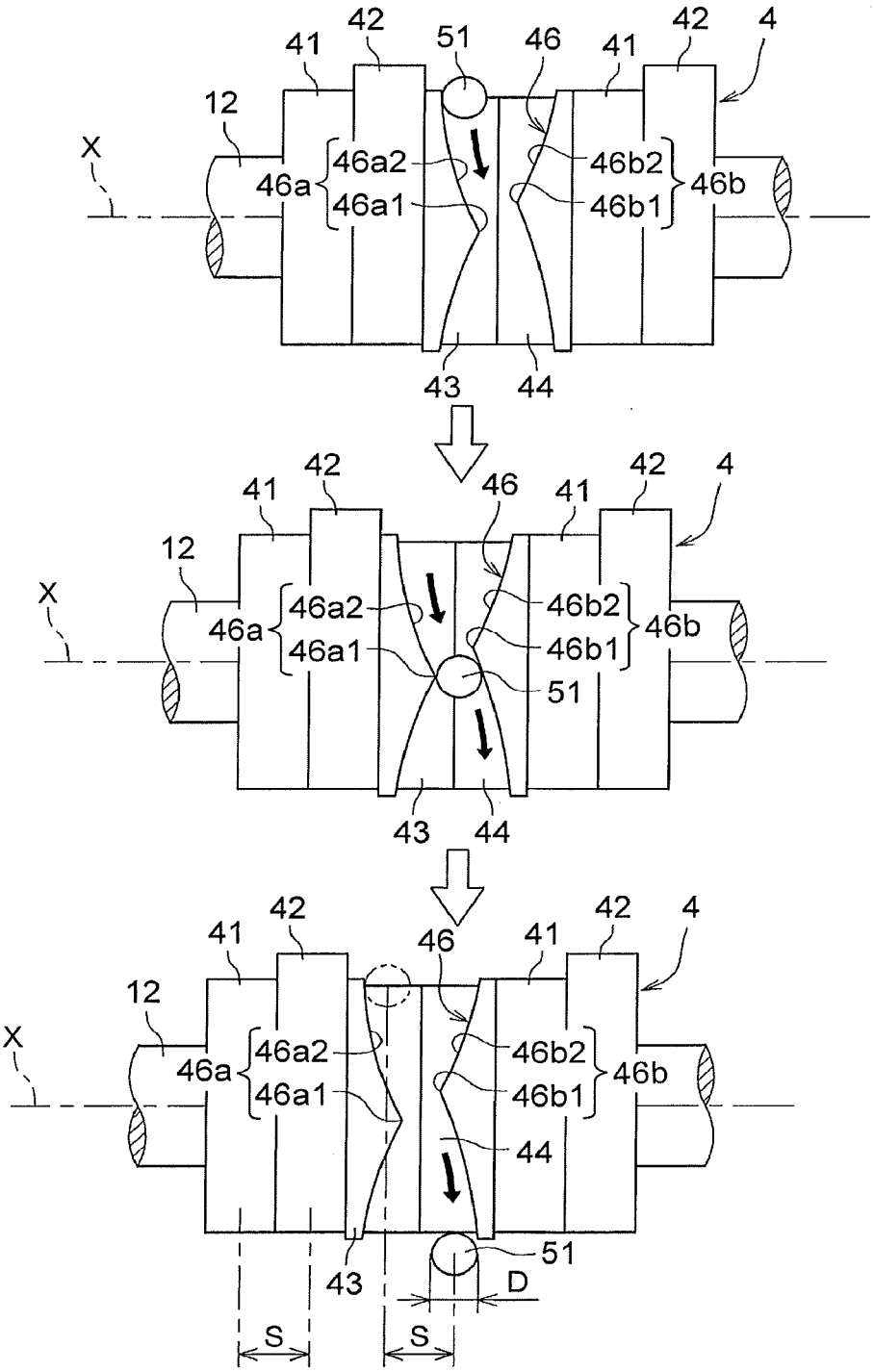
FIG. 6 is a view illustrating sliding of the cam unit toward a first side due to engagement between a shift pin and the guide groove.

Then, the shift pin 51 passes through between two projecting ends 46*a*1, 46*b*1 positioned such that the distance d between the two projecting ends 46*a*1, 46*b*1 is large, and the shift pin 51 relatively moves toward the right side of the guide groove 46 as illustrated on a lower side in FIG. 6. The cam unit 4 slides when the shift pin 51 relatively moves in the width direction of the guide groove 46. In order to switch from the low lift cam 41 to the high lift cam 42, the cam unit 4 is slid by a distance S (a length in the X-axis direction) between two cams 41, 42.

That is, as illustrated on the lower side in FIG. 6, an amount of relative movement of the shift pin 51 to the right side on an outer peripheral surface of the cam unit 4 needs to be made the same as the distance S between the two cams 41, 42. Accordingly, when a diameter of the shift pin 51 is D, a width (a length in the X-axis direction) of the guide groove 46 needs to be set to approximately S+D, in order to slide the cam unit 4 to switch to the high lift cam 42 from the low lift cam 41.

In the present embodiment, a locking mechanism 6 is provided so as to hold a position (the low lift position or the high lift position) of the cam unit 4 when the low lift cam 41 is switched to the high lift cam 42 or vice versa. That is, two annular grooves 43*c*, 43*d* are formed side by side near a center in the X-axis direction (the right-left direction in FIG. 4) on an inner peripheral surface of the sleeve 43 of the cam unit 4 as illustrated in FIG. 4, and an annular projection 43*e* formed to remain therebetween is disposed substantially in a center in the X-axis direction.

A locking member 61 is retractably disposed on the outer periphery of the intake camshaft 12 so as to be engaged with a corresponding one of the annular grooves 43*c*, 43*d* at the time when the cam unit 4 is placed at the low lift position or the high lift position. For example, the locking member 61 is a locking ball. The locking member 61 is accommodated in a hole portion 12*a* having a circular sectional shape and opened on an outer peripheral surface of the intake camshaft 12, and is pressed outwardly by a coil spring 62. That is, the locking member 61 is pressed toward the inner peripheral surface of the sleeve 43, which is disposed radially outside the locking member 61 and faces the locking member 61, from the hole portion 12*a* of the intake camshaft 12.

With this configuration, when the cam unit 4 is placed at the low lift position on the second side in the X-axis direction (the right side in FIG. 4) as illustrated on an upper side in FIG. 4, the locking member 61 is engaged with the annular groove 43*c*. When the cam unit 4 is placed at the high lift position on the first side in the X-axis direction (the left side in FIG. 4) as illustrated on a lower side in FIG. 4, the locking member 61 is engaged with the annular groove 43*d*. Further, as described above with reference to FIG. 6, when the cam unit 4 slides to the high lift position from the low lift position, the locking member 61 in the locking mechanism 6 moves across the annular projection 43*e*.

That is, the locking member 61 is first pushed down by the annular projection 43*e* along with sliding of the cam unit 4, and moves downward against a spring force of the coil spring 62 so as to move away from the annular groove 43*c*. Although not illustrated, when the cam unit 4 passes a central position between the low lift position and the high lift position, the locking member 61 moves across the annular projection 43*e*, and then, the locking member 61 is fitted into the annular groove 43*d* by a spring force of the coil spring 62. Thus, the cam unit 4 further slides toward the left side.

Note that, in the present embodiment, a depth of the guide groove 46 is largest at a part corresponding to the guide portion 46*b* as illustrated in FIG. 3, and the depth gradually decreases in the circumferential direction away from this part. A part 46*c* whose depth decreases toward the front side in the cam rotation direction is an introduction zone 46*c* in which the shift pin 51 starts to be engaged with the guide groove 46, while a part 46*d* whose depth decreases toward the rear side in the cam rotation direction is a lead-out zone 46*d* in which the shift pin 51 is retracted from the guide groove 46.

An operation of the cam switch mechanism is described below with reference to FIGS. 6 and 7. First, during an operation of the engine 1, when the low lift cam 41 is selected as described above with reference to FIG. 2, the lift and the duration of the intake valve 10 driven via the rocker arm 15 are relatively small. At this time, as illustrated on the upper side in FIG. 6, the movable piece 44 in the cam unit 4 is placed at the first position, and the right guide portion 46*b* thereof is placed on the front side (the upper side in FIG. 6) in the cam rotation direction relative to the left guide portion 46*a*.

When the actuator 5 is turned on in this state to switch to the high lift cam 42, the shift pin 51 advances so as to be engaged with the left side surface of the guide groove 46. In this case, the shift pin 51 is preliminarily caused to advance in the introduction zone 46*c* formed to be relatively shallow such that the distal end of the shift pin 51 is pressed against a bottom surface of the guide groove 46 (i.e., a bottom surface of the introduction zone 46*c*). Thus, the shift pin 51 gradually advances so as to be smoothly engaged with the left side surface of the guide groove 46, along with the rotation of the intake camshaft 12.

When the cam unit 4 further rotates, the shift pin 51 slides on the guide face portion 46*a*2 on the left side surface of the guide groove 46 as illustrated from the upper side to the center in FIG. 6, and thus, the shift pin 51 reaches the projecting end 46*a*1 of the guide portion 46*a*. In the meantime, the shift pin 51 practically presses the cam unit 4 toward the left side via the guide face portion 46*a*2 so as to slide the cam unit 4. Accordingly, the locking member 61 (see the upper side in FIG. 4) engaged with the annular groove 43*c* on the inner periphery of the sleeve 43 of the cam unit 4 is pushed down by the annular projection 43*e*.

That is, when the shift pin 51 reaches the projecting end 46*a*1 of the guide portion 46*a* as illustrated in the center in FIG. 6, a center of the shift pin 51 relatively moves toward the right side across a central position of the guide groove 46 in the width direction, and at this time, the locking member 61 moves across the annular projection 43*e*. The locking member 61 that has moved across the annular projection 43*e* is fitted into the annular groove 43*d* by the spring force of the coil spring 62. Thus, the cam unit 4 further slides toward the left side.

Thus, as illustrated from the center to the lower side in FIG. 6, the shift pin 51 passes through between the projecting ends 46*a*1, 46*b*1 facing each other and relatively moves from the left side to the right side of the guide groove 46. When the cam unit 4 thus slides to the high lift position, the rocker arm 15 is pushed down by the high lift cam 42, although not illustrated. As a result, the intake valve 10 operates such that the lift and the duration of the intake valve 10 are large. Note that, while the cam unit 4 slides from the low lift position to the high lift position, the roller 15*a* of the rocker arm 15 is pressed against the base circle zones of the low lift cam 41 and the high lift cam 42.

The shift pin 51 that has relatively moved to the right side surface of the guide groove 46 as described above moves away from the guide portion 46*b* along with the rotation of the cam unit 4, as illustrated on the lower side in FIG. 6. If the actuator 5 is turned off at this time, the shift pin 51 is gradually moved back in the lead-out zone 46*d* of the guide groove 46 and is retracted to a position at which the shift pin 51 is not engaged with the guide groove 46. Accordingly, after that, until the actuator 5 is turned on again to cause the shift pin 51 to advance, the shift pin 51 does not interfere with the guide groove 46.

Subsequently, an operation to switch from the high lift cam 42 to the low lift cam 41 (i.e., an operation performed in a case where the high lift cam 42 has been selected as described above and the cam is switched from the high lift cam 42 to the low lift cam 41) is described with reference to FIG. 7. Also in FIG. 7, the first side in the width direction (the X-axis direction) of the guide groove 46 is referred to as the left side and the second side is referred to as the right side, for convenience. Since the cam unit 4 is placed at the high lift position, when the actuator 5 is turned on, the shift pin 51 advances and is engaged with the right side surface of the guide groove 46 as illustrated on an upper side in FIG. 7.

Figure 7:
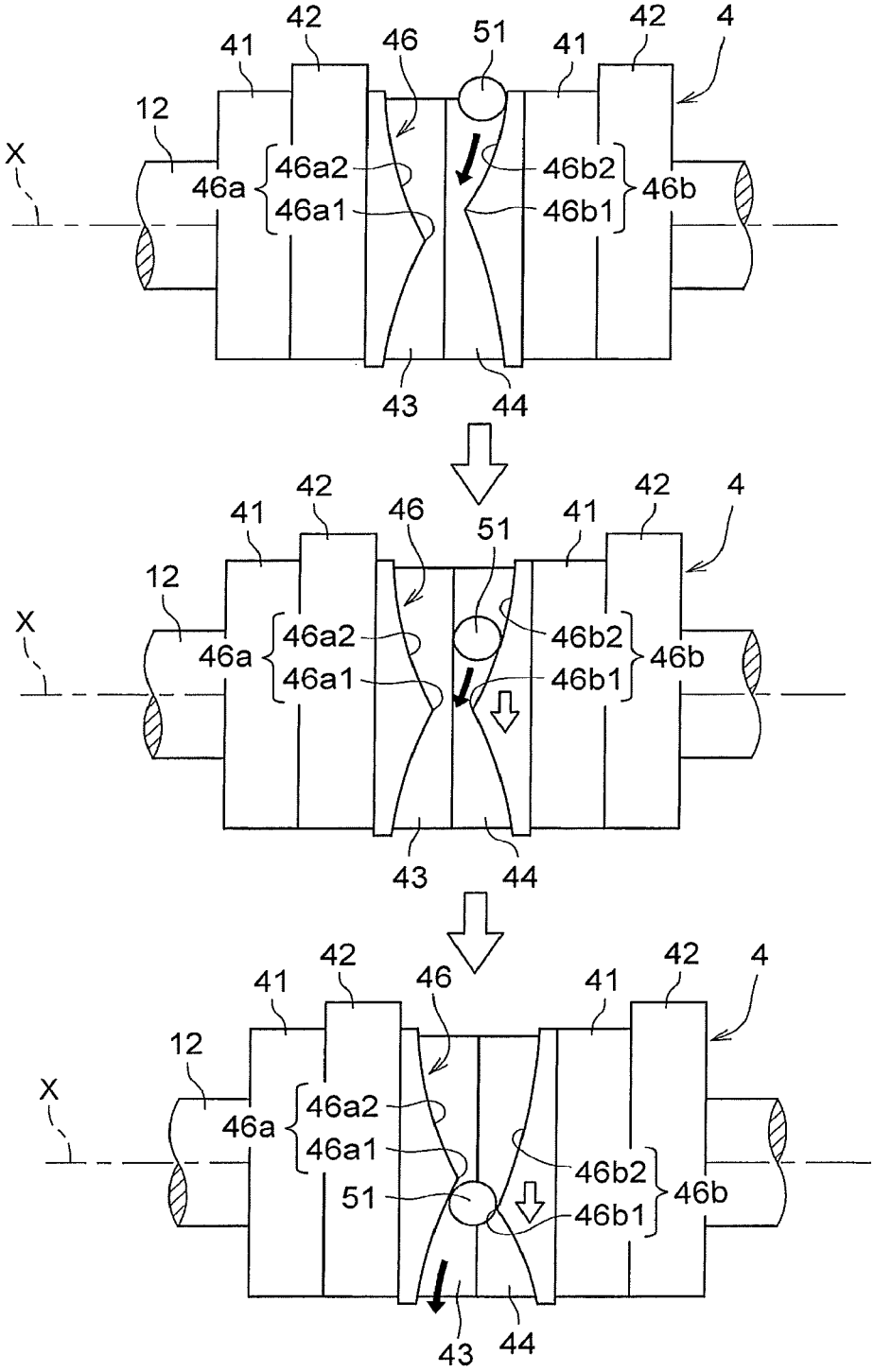
FIG. 7 is a view corresponding to FIG. 5 and illustrating sliding of the cam unit toward a second side.

Then, along with the rotation of the intake camshaft 12 and the cam unit 4, the shift pin 51 slides along the guide face portion 46*b*2 on the right side surface of the guide groove 46 as illustrated in a center in FIG. 7, so as to press and slide the cam unit 4 to the right side. At this time, the shift pin 51 presses the guide face portion 46*b*2 toward the right side, and in addition, the shift pin 51 presses the guide face portion 46*b*2 toward the rear side (a lower side in FIG. 7) in the cam rotation direction. Thus, the movable piece 44 pivots toward the rear side in the cam rotation direction against a spring force of the coil spring 45.

When the movable piece 44 thus pivots, the guide portion 46*b* on the right side surface of the guide groove 46 is displaced to the second position (also see the lower side in FIG. 5), which is on the rear side in the cam rotation direction relative to the guide portion 46*a* on the left side surface, as illustrated on the lower side in FIG. 7. Thus, the projecting ends 46*a*1, 46*b*1 are displaced from each other in the front-rear direction along the cam rotation direction, and accordingly, the distance between the projecting ends 46*a*1, 46*b*1 facing each other becomes large and the shift pin 51 passes through therebetween.

When the shift pin 51 passes through between the projecting ends 46*a*1, 46*b*1 of the guide portions 46*a*, 46*b*, the locking member 61 moves across the annular projection 43*e* so as to be fitted into the annular groove 43*c*, on the inner periphery of the sleeve 43 of the cam unit 4, in a manner similar to the manner in which the position of the cam unit 4 is switched from the low lift position to the high lift position. Thus, the cam unit 4 further slides toward the right side, so that the shift pin 51 that has passed through between the projecting ends 46*a*1, 46*b*1 relatively moves to the left side of the guide groove 46.

When the cam unit 4 thus slides from the high lift position to the low lift position, the rocker arm 15 is pushed down by the low lift cam 41, although not illustrated. As a result, the intake valve 10 operates such that the lift and the duration of the intake valve 10 are small. Note that, when the shift pin 51 passes through between the projecting ends 46*a*1, 46*b*1 as described above and thus stops pressing the right guide face portion 46*b*2, the movable piece 44 pivots forward in the cam rotation direction by the spring force of the coil spring 45 and returns to the first position.

In the variable valve mechanism of the present embodiment as described above, the cam unit 4 including the low lift cam 41 and the high lift cam 42 is provided around the intake camshaft 12, and the shift pin 51 is engaged with the guide groove 46 provided on the outer periphery of the cam unit 4, so as to slide the cam unit 4 toward the first side (one side) or the second side (the other side) in the X-axis direction. Thus, the lift of the intake valve 10 can be switched between a low lift state and a high lift state by selecting one of the low lift cam 41 and the high lift cam 42.

When the cam unit 4 is slid toward the first side or the second side in the X-axis direction, the shift pin 51 is engaged with the side surface of the guide groove 46 on the first side or the side surface of the guide groove 46 on the second side in the width direction, and the shift pin 51 is relatively moved from the first side to the second side by the guide portion 46*a* on the first side, or the shift pin 51 is relatively moved from the second side to the first side by the guide portion 46*b* on the second side, thereby making it possible to slide the cam unit 4 toward the first side and the second side along the X-axis direction in a reciprocating manner.

Figure 8:
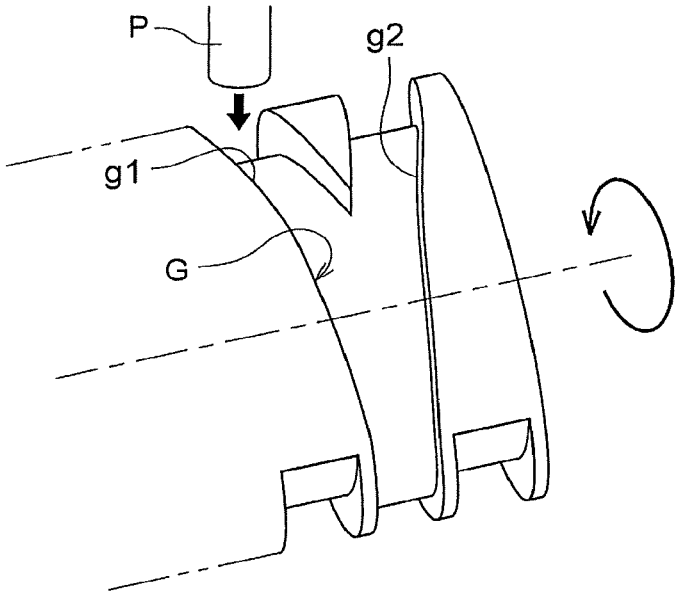
FIG. 8 RELATED ART
FIG. 8 is a perspective view illustrating a Y-shaped guide groove provided in a cam carrier in a conventional example.

Thus, as described above with reference to FIG. 6, when a slide amount of the cam unit 4 is indicated by S and a diameter of the shift pin 51 is indicated by D, a width (a length in the X-axis direction) of the guide groove 46 required for relative movement of the shift pin 51 is approximately S+D, which is smaller than a width (2×S+D) of the Y-shaped guide groove G (see FIG. 8) in the related art (i.e., the conventional example). Thus, the cam unit 4 has the reduced size.

Figure 9:
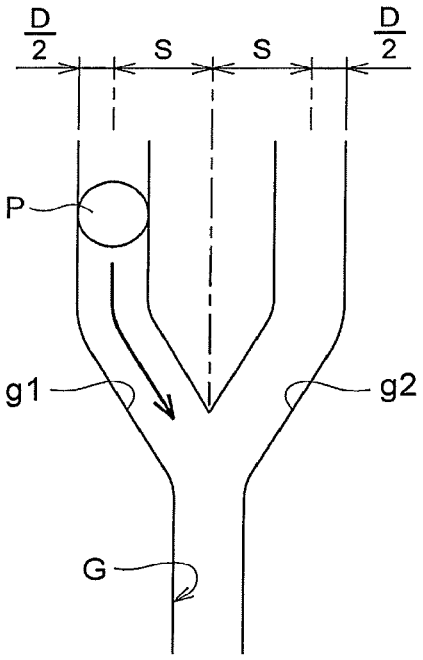
FIG. 9 RELATED ART
FIG. 9 is a development view illustrating a required width of the guide groove in the conventional example.

Further, in order to move the cam unit 4 to the first side in the X-axis direction, the shift pin 51 is engaged with the side surface of the guide groove 46 on the first side, and in order to move the cam unit 4 to the second side in the X-axis direction, which is opposite to the first side, the shift pin 51 is engaged with the side surface of the guide groove 46 on the second side. That is, when the side, to which the cam unit 4 is moved, is changed, only the side surface of the guide groove 46, with which the shift pin 51 is engaged, is changed to the side surface on the first side or the side surface on the second side. Thus, only one shift pin 51 is necessary. In this regard, it is possible to achieve reduction in cost as compared to the example (the conventional example described above with reference to FIGS. 8 and 9) that requires two shift pins, and although the movable piece 44 is provided in the cam unit 4, an increase in cost can be suppressed.

Further, in the present embodiment, the distance (the distance d0 in the groove-width direction) between the projecting ends 46*a*1, 46*b*1 of the guide portions 46*a*, 46*b* on the respective side surfaces of the guide groove 46 is smaller than the outside diameter D of the shift pin 51. On this account, when the shift pin 51 reaches the projecting ends 46*a*1, 46*b*1, the center of the shift pin 51 relatively moves across the central position of the guide groove 46 in the width direction, and at this time, the cam unit 4 passes the central position of a slide. Therefore, at this time, in the locking mechanism 6 of the cam unit 4, the locking member 61 moves across the annular projection 43*e*, and the cam unit 4 does not return to its original side after that.

The disclosure is not limited to the configuration described in the above embodiment. The above embodiment is just an example, and the configuration, the purpose, and the like of the disclosure are not limited to those in the above embodiment. For example, in the above embodiment, the guide groove 46 is provided on the outer periphery of the sleeve 43 of the cam unit 4, at a position near the center in the X-axis direction. However, the disclosure is not limited to this configuration, and the guide groove 46 may be provided close to an end on the first side or the second side.

Further, in the above embodiment, the guide groove 46 is provided on the outer periphery of the sleeve 43. However, the disclosure is not limited to this configuration, and the guide groove 46 may be provided on an outer periphery of a cylindrical member formed separately from the sleeve 43, and the cylindrical member may be connected to an end of the sleeve 43 on the first side or the second side. In this case, the cam unit 4 includes the cylindrical member in addition to the low lift cam 41, the high lift cam 42, and the sleeve 43.

Further, in the above embodiment, the sleeve 43 of the cam unit 4 is an immovable piece and the movable piece 44 is provided around the reduced diameter part 43*a* provided in the sleeve 43. However, the disclosure is not limited to this configuration. For example, an immovable piece may be formed separately from the sleeve 43 and fitted to the sleeve 43.

Further, in the cam unit 4 of the above embodiment, the guide groove 46 is divided at the center in the width direction. However, the disclosure is not limited to this configuration, and the guide groove 46 may be divided at a position closer to the first side or the second side than the center. Further, the distance d0 in the groove-width direction between the projecting ends 46*a*1, 46*b*1 of the pair of guide portions 46*a*, 46*b* on the respective side surfaces of the guide groove 46 is smaller than the outside diameter D of the shift pin 51. However, the disclosure is not limited to this configuration, and the distance d0 in the groove-width direction may be larger than the outside diameter D of the shift pin 51.

Further, in the cam unit 4 of the above embodiment, the coil spring 45 is used as a first urging member that urges the movable piece 44 toward the front side in the cam rotation direction relative to the sleeve 43. However, the first urging member may be a spring member other than the coil spring, and the first urging member is not limited to the spring member. For example, the movable piece 44 may be configured to be urged toward the front side in the cam rotation direction relative to the sleeve 43 with the use of a hydraulic pressure of a lubrication system of the engine 1.

Furthermore, the above embodiment deals with the cam switch mechanism that switches the lift characteristic of the intake valve 10 in a Double Overhead Camshaft (DOHC) type valve system of the engine 1. However, the disclosure is not limited to this configuration, and the disclosure can be also applied to a cam switch mechanism that switches a lift characteristic of the exhaust valve 11. Further, the valve system is not limited to the DOHC type valve system, and the disclosure can be also applied to a Single Overhead Camshaft (SOHC) type valve system.

In the disclosure, a cam unit can be configured to be compact in a cam-switching variable valve mechanism. Accordingly, the disclosure is highly effective, for example, when the disclosure is applied to an engine provided in an automobile.

What is claimed is:

1. A variable valve mechanism, comprising:

a cam unit having a cylindrical shape and including a plurality of cams, the cam unit being provided around a camshaft; and a shift pin, wherein any one of the plurality of cams provided in the cam unit is selected by engaging the shift pin, from an outside, with a guide groove provided on an outer periphery of the cam unit so as to slide the cam unit in an axial direction of the camshaft along with rotation of the camshaft;

the guide groove includes a first guide portion and a second guide portion provided on a first side surface and a second side surface respectively in a width direction of the guide groove, the first guide portion and the second guide portion projecting so as to face each other;

the guide groove is configured such that the cam unit is slid toward a first side by relatively moving the shift pin toward a second side with use of the first guide portion, and the cam unit is slid toward the second side by relatively moving the shift pin toward the first side with use of the second guide portion;

the guide groove is divided into two parts in the width direction of the guide groove, the first guide portion is provided in a sleeve so as not to pivot relative to the cam unit, and the second guide portion is provided in a ring so as to be pivotable relative to the cam unit;

the ring is displaceable relative to the sleeve between a first position and a second position, the first position being a position to which the ring pivots in a direction in which the camshaft rotates, and the second position being a position to which the ring pivots in a direction opposite to the direction in which the camshaft rotates; and a first spring configured to urge the ring toward the first position is provided.

2. The variable valve mechanism according to claim 1, wherein the first spring is provided between the ring and the sleeve.

3. The variable valve mechanism according to claim 1, wherein:

each of the first guide portion and the second guide portion includes a guide face configured such that a projecting amount of the guide face gradually decreases from a projecting end of the respective first guide portion and second guide portion toward a front side in the direction in which the camshaft rotates; and a distance between the projecting ends facing each other is smaller than an outside diameter of the shift pin in the width direction of the guide groove.

4. The variable valve mechanism according to claim 1, wherein:

one of the camshaft and the cam unit is provided with a projection projecting toward the other one of the camshaft and the cam unit; and the other one of the camshaft and the cam unit is provided with a lock such that the lock is pressed by a second spring toward the projection and the lock moves across the projection at a central position in a slide of the cam unit.

5. The variable valve mechanism according to claim 4, wherein:

the lock is a ball pressed by the second spring.

* * * * *